US011732721B2

(12) United States Patent
Tyni

(10) Patent No.: US 11,732,721 B2
(45) Date of Patent: Aug. 22, 2023

(54) FAN

(71) Applicant: Napalmi Tietotekniikka Oy, Hyvinkää (FI)

(72) Inventor: Jarno Tyni, Hyvinkää (FI)

(73) Assignee: Napalmi Tietotekniikka Oy, Hyvinkää (FI)

( * ) Notice: Subject to any disclaimer, the term of this patent is extended or adjusted under 35 U.S.C. 154(b) by 0 days.

(21) Appl. No.: 17/730,534

(22) Filed: Apr. 27, 2022

(65) Prior Publication Data

US 2022/0349409 A1 Nov. 3, 2022

(30) Foreign Application Priority Data

Apr. 29, 2021 (FI) ..... 20215499

(51) Int. Cl.

| | |
|---|---|
| ***F04D 19/02*** | (2006.01) |
| ***F04D 19/00*** | (2006.01) |
| ***F04D 25/08*** | (2006.01) |
| ***F04D 25/16*** | (2006.01) |
| ***F04D 29/38*** | (2006.01) |
| ***F04D 29/58*** | (2006.01) |

(52) U.S. Cl.

CPC ..... *F04D 19/024* (2013.01); *F04D 19/007* (2013.01); *F04D 25/08* (2013.01); *F04D 25/166* (2013.01); *F04D 29/384* (2013.01); *F04D 29/5826* (2013.01)

(58) Field of Classification Search

CPC ..... F04D 19/024; F04D 19/007; F04D 25/08; F04D 25/166; F04D 29/384; F04D 29/5826

USPC ..... 415/1

See application file for complete search history.

(56) References Cited

U.S. PATENT DOCUMENTS

| | | | | |
|---|---|---|---|---|
| 4,431,048 A | | 2/1984 | Mori et al. | |
| 6,009,763 A | * | 1/2000 | Berckmans | G01F 25/15 416/223 R |
| 6,139,425 A | * | 10/2000 | Yazici | F24F 13/04 454/261 |
| 6,241,600 B1 | * | 6/2001 | Uehara | F24F 7/013 454/235 |
| 6,565,334 B1 | * | 5/2003 | Bradbury | F04D 29/384 417/244 |

(Continued)

FOREIGN PATENT DOCUMENTS

| | | |
|---|---|---|
| CN | 205225794 U | 5/2016 |
| DE | 4440436 A1 | 4/1996 |

(Continued)

OTHER PUBLICATIONS

Finnish Patent and Registration Office, Office Action, Application No. 20215499, dated Jun. 1, 2021, 6 pages.

(Continued)

*Primary Examiner* — Logan M Kraft
*Assistant Examiner* — John D Bailey
(74) *Attorney, Agent, or Firm* — Ziegler IP Law Group LLC

(57) ABSTRACT

The aspects of the disclosed embodiments are directed to a fan for displacing a fluid, which fan includes a rotor rotating around its axis of rotation and surfaces, such as blades, forming a flow when the rotor rotates. The rotor is arranged to displace fluid simultaneously with at least two different flows (F1, F2).

14 Claims, 6 Drawing Sheets

(56) References Cited

U.S. PATENT DOCUMENTS 7,381,129 B2 * 6/2008 Avedon ..... F04D 29/542 416/247 R
7,441,588 B2 * 10/2008 Matsugi ..... F24F 7/007 165/95
7,600,961 B2 * 10/2009 Abdallah ..... F04D 25/045 415/58.4
7,713,026 B1 * 5/2010 Liang ..... F01D 5/186 415/115
7,892,306 B2 * 2/2011 Kummer ..... B01D 46/42 415/53.3
8,430,730 B2 * 4/2013 Feisthammel ..... F24F 13/04 55/447
8,789,766 B2 * 7/2014 Baldauf ..... F24F 13/04 454/126
8,894,478 B1 * 11/2014 Stillwagon ..... F24F 8/10 454/231
10,845,065 B1 * 11/2020 Rosario ..... F04D 1/025
2005/0167077 A1 * 8/2005 Matsugi ..... F24F 12/006 165/4
2010/0124483 A1 * 5/2010 Weaver ..... F01D 9/065 415/115
2010/0278629 A1 * 11/2010 Krippene ..... F03D 3/0436 415/58.4
2011/0100014 A1 * 5/2011 Hyde ..... F02K 3/06 416/223 R
2011/0174011 A1 * 7/2011 Kim ..... F24F 1/40 62/426
2014/0093350 A1 * 4/2014 Meisner ..... F01D 17/08 415/17
2014/0119881 A1 * 5/2014 Kalra ..... F01D 11/04 415/182.1
2014/0167419 A1 * 6/2014 Quek ..... F03D 80/00 290/55
2014/0178173 A1 * 6/2014 Colson ..... F04D 29/00 29/428
2014/0271121 A1 * 9/2014 Kupratis ..... F01D 9/02 415/207
2014/0300109 A1 * 10/2014 Palmer ..... F04D 5/002 415/55.1
2014/0301821 A1 * 10/2014 Palmer ..... F04D 17/122 415/55.3
2014/0371919 A1 * 12/2014 Creamer ..... F04C 18/0207 415/113
2015/0016944 A1 * 1/2015 Vandervaart ..... F01D 5/187 164/520
2015/0240722 A1 * 8/2015 Loebig ..... F28F 3/048 415/177
2015/0300195 A1 * 10/2015 Lutjen ..... F01D 25/12 415/173.1
2015/0300265 A1 * 10/2015 Suciu ..... F02C 7/052 415/1
2015/0308460 A1 * 10/2015 Lucic ..... B64D 13/06 415/121.2
2016/0047360 A1 * 2/2016 Fex, Jr. ..... F24F 11/0001 415/121.3
2016/0169017 A1 * 6/2016 Giacché ..... F04D 29/526 415/168.1
2016/0169026 A1 * 6/2016 Jones ..... F01D 5/12 415/1
2016/0177829 A1 * 6/2016 Loebig ..... F28D 9/0037 415/177
2021/0332828 A1 * 10/2021 Cai ..... F24F 1/0033
2021/0388838 A1 * 12/2021 Hu ..... F04D 29/32
2021/0388839 A1 * 12/2021 Li ..... F04D 29/703
2022/0154722 A1 * 5/2022 Lyons ..... F04D 19/005

FOREIGN PATENT DOCUMENTS

DE 19741161 A1 6/1999
DE 102008058817 A1 7/2013
DE 102013111389 A1 4/2015
JP H07247994 A 9/1995
JP H10306796 A 11/1998
KR 20020069780 A 9/2002

OTHER PUBLICATIONS

Finnish Patent and Registration Office, Search Report, Application No. 20215499, dated Jun. 1, 2021, 2 pages.
European Patent Office, cf Form 1507, Application No. 22165595.4, dated Sep. 12, 2022, 4 pages.
European Patent Office, European Search Report, Application No. EP22165595, dated Sep. 12, 2022, 2 pages.
European Patent Office, Information on Search Strategy, Application No. 22165595, dated Sep. 12, 2022, 1 page.

* cited by examiner

FAN

FIELD

The aspects of the disclosed embodiments are directed to a fan and the use of the fan The solution according to the disclosed embodiments is suited e.g. for use in a fan rotor or corresponding rotating heat exchanger displacing air and simultaneously heat, wherein two air flows in opposite, different, crosswise, or parallel directions are produced.

BACKGROUND

It is known for conventional ventilation machines or ventilation arrangements to have two fan motors as well as a heat exchanger or rotating radiator, with which heat and moisture are displaced. One problem is that these easily freeze solid or cause mixing of the exhaust air and the supply air.

It is known that attempts have been made to solve the aforementioned problems by adapting the arrangement to be more efficient, e.g. by adding heat pumps or by using a rotating heat exchanger. This, however, makes the arrangement more complex, in which case costs also increase.

Automobiles are not known to have utilized heat recovery from ventilation, owing to the abundant waste heat from combustion engines. Electric vehicles, however, do not have them.

The problems in fan solutions according to prior art are, inter alia, freezing, the mixing of air flows, unnecessary complexity, difficulties in modernization, and expensive production costs.

Korean patent specification no. KR 20020069780 A discloses a fan solution that produces two separate flows. This solution, however, differs from the solution according to the invention at least insofar as the rotor of the fan is not intended as a heat exchanger for transferring heat from one flow to another.

German patent publication no. DE 19741161 A1 discloses a fan solution that produces at least two separate flows. This solution also differs from the solution according to the invention at least insofar as the rotor of the fan is not intended as a heat exchanger for transferring heat from one flow to another.

United States patent specification no. US 2005167077 A1 discloses a fan solution that produces at least two separate flows. This solution differs from the solution according to the invention at least insofar as it comprises more than one rotor and the rotors are not intended as heat exchangers for transferring heat from one flow to another, but instead the solution comprises a separate heat exchanger.

SUMMARY

The purpose of the disclosed embodiments is to eliminate the aforementioned drawbacks and to provide a new type of fan and ventilation arrangement, wherein at least two separate flows are produced with one fan. The fan according to the disclosed embodiments is characterized by what is disclosed in the claims. Use of the fan according to the invention is characterized by what is disclosed in the claims. Other embodiments of the invention are characterized by what is disclosed in the other claims.

What is characteristic of the solution according to the disclosed embodiments is that with one rotating motor or other power means, two or more flows are produced with one rotor/fan. Additionally, heat transfer occurs in the rotor between the media, such as e.g. air or some other gas or liquid, i.e. fluid. The fan according to the invention is characterized in that the fan comprise surfaces, such as blades, forming a flow when they move, and in that the fan is arranged to displace fluid simultaneously with at least two different flows.

One advantage, among others, of the solution according to the disclosed embodiments is that the rotating fan rotor displacing heat keeps the two flows in different directions separated. One advantage is also that the moisture condensing on the fan is spun out immediately by centrifugal force, preventing freezing of the heat exchanger. It is also an advantage that the fan is inexpensive to manufacture and is easy to maintain and modify during its service life. A further advantage is that the fan according to the disclosed embodiments is simpler than earlier solutions because it has fewer moving parts and no other parts than in prior-art solutions. Manufacture of the fan is also easy and therefore also cost-efficient. It is also an advantage that the manufacturing material of the fan can be selected from a very wide range of materials to be suitable for each specific purpose. Another advantage is also savings in space and reduced energy consumption. Another advantage is the heat recovery enabled by the fan, e.g. for an electric vehicle or house or other process, with one part.

BRIEF DESCRIPTION OF THE DRAWINGS

In the following the disclosed embodiments will be described in more detail with reference to the attached simplified drawings, wherein.

DETAILED DESCRIPTION

Figure 1:
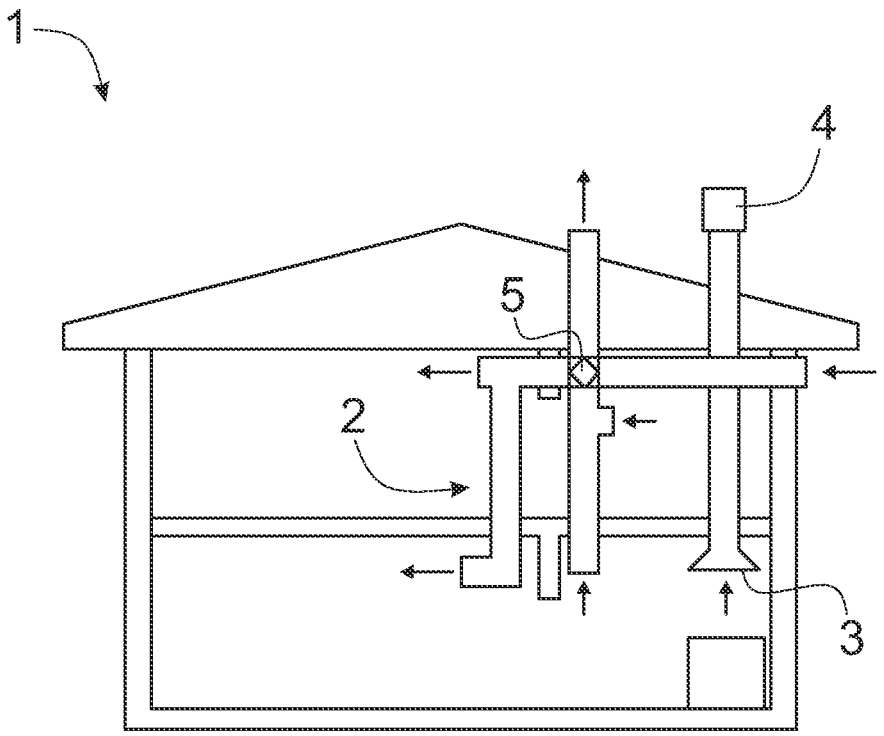
FIG. 1 presents a ventilation solution of a building, in which solution a fan according to the disclosed embodiments can be used.

FIG. 1 presents a simplified and diagrammatic view of one building and its ventilation system, in which a fan according to the disclosed embodiments can be used. The ventilation system of the building 1 comprises, inter alia, piping 2, a kitchen cooker hood 3, a roof exhaust fan 4 and also a ventilation machine 5. Owing to the solution according to the disclosed embodiments, the heat of the exhaust air can be recovered more simply than in solutions known in the art. According to the disclosed embodiments, two air flows in different directions are brought about with one fan, in which case there are savings in costs because less space and fewer parts are needed. The fan according to the disclosed embodiments is in connection with a ventilation machine 5, which is arranged to heat/cool the supply air coming from outside by means of the heat of the outgoing exhaust air.

Figure 2A:
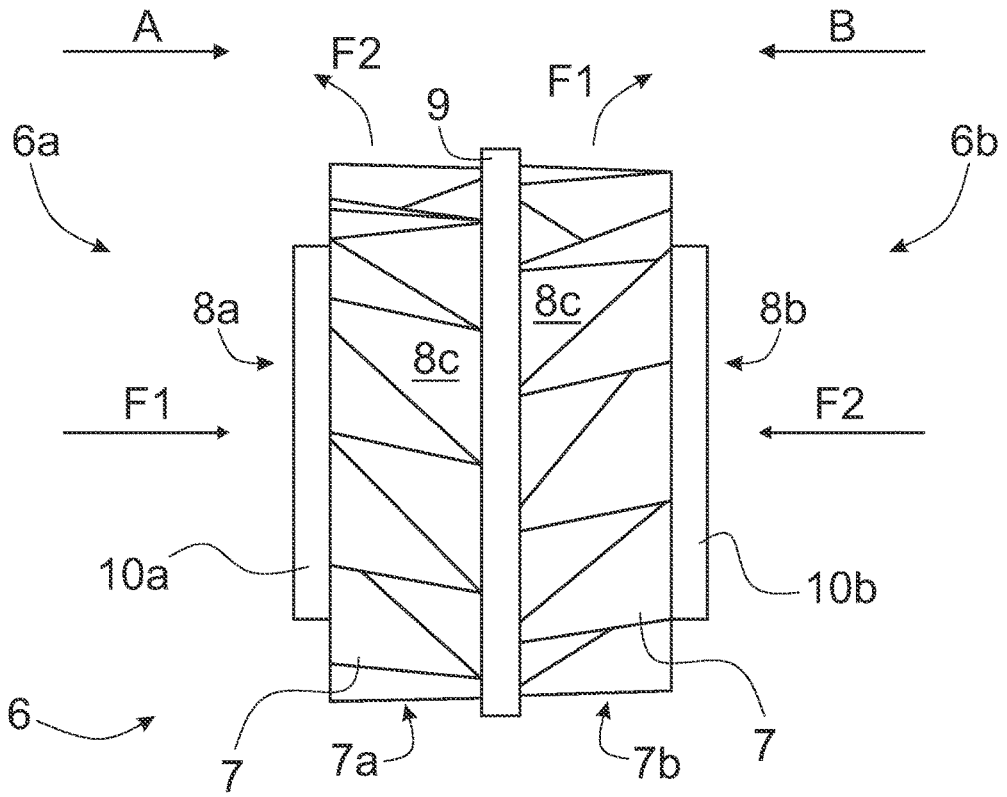
FIG. 2*a* presents a side view of the rotor of a fan according to one embodiment.
Figure 2B:
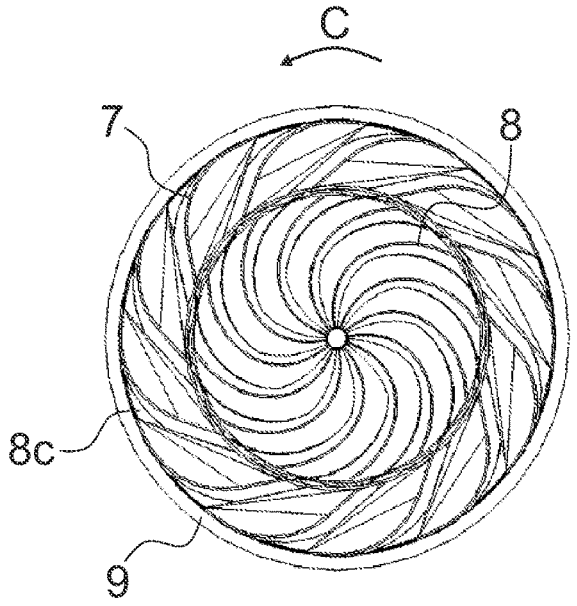
FIG. 2*b* presents a front view of the rotor of a fan according to one embodiment.
Figure 2C:
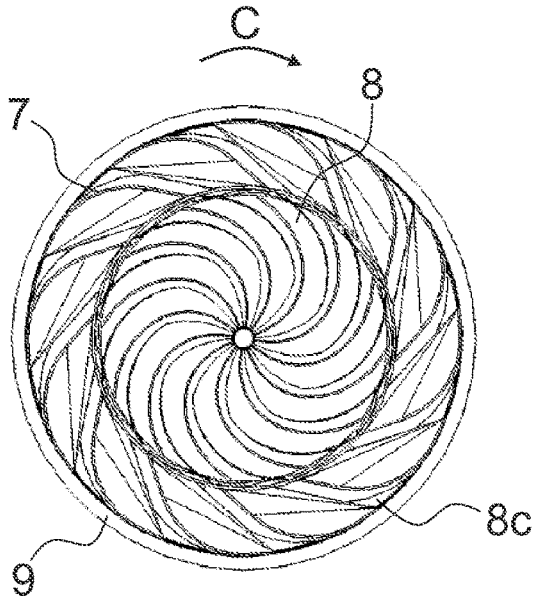
FIG. 2*c* presents a rear view of the rotor of a fan according to one embodiment.

FIG. 2*a* presents a side view, FIG. 2*b* a front view and FIG. 2*c* a rear view of the rotor 6 of a fan according to one embodiment of the disclosed embodiments. FIG. 2*b* is presented from the direction of the arrow A in FIG. 2*a* and FIG. 2*c* is presented from the direction of the arrow B in FIG. 2*a*. One main idea of the disclosed embodiments is to form a bidirectional or multidirectional blowing/flow in one piece. Air or some other fluid is blown, i.e. displaced, with the fan. This application refers mainly to air flows, but these flows could just as easily be flows of some other fluid. The rotor 6 comprises a first rotor side 6*a* and a second rotor side 6*b*. The rotor 6 also comprises an inner section 8*a* provided with inner vanes, i.e. inner blades 8, as well as an outer section 7*a* provided with outer vanes, i.e. outer blades 7. The inner blades 8, however, continue by virtue of their extensions 8*c* also to the side of the outer sections 7*a*. The fan thus comprises a rotor 6, which is arranged to rotate around its axis of rotation. The rotor 6 is arranged to be rotated e.g. by means of a motor, which motor is e.g. an electric motor. The inner blades 7 and outer blades 8 are thus arranged to be rotated by means of the same power source at the same time and at the same speed. Speed in this context means angular velocity. Each outer blade 7 and each inner blade 8 comprises two surfaces, which are on opposite sides of the blade with respect to each other. The surfaces of outer blades 7 and of the inner blades 8 form a flow when they move, i.e. when the rotor 6 rotates around its axis of rotation. When the rotor 6 is rotated, the inner blades 8 and outer blades 7 bring about two separate flows that are in opposite directions to each other, at least essentially. The first flow and its direction is presented in the figure with the arrow F1 and the second flow and its direction with the arrow F2. The inner blades 8 suck air into the rotor 6 and the outer blades 7 blow the air sucked in from the second side of the rotor 6 out along the flow channels, which flow channels are led from the inner section 8*a* of the first rotor side 6*a* into the outer section 7*b* of the second rotor side 6*b* and from the inner section 8*b* of the second rotor side 6*b* into the outer section 7*a* of the first rotor side 6*a*. The aforementioned flow channels are brought about by the shaping and dimensioning of the rotor 6 and its blades. From between the adjacent blades of the inner blades 8 starts one flow channel that leads to the second side of the rotor between certain adjacent outer blades 7. One interspace of the inner blades on the first rotor side 6*a* corresponds to one interspace of the outer blades on the second rotor side 6*b*, and each of these type of interspaces has one flow channel. There are therefore just as many flow channels in the rotor 6 from one side to the other as one rotor side has inner blades 8 or outer blades 7. The different flow channels are realized with suitable shaping of the inner blades 8 and outer blades 7. The flow channels leading from the first rotor side 6*a* to the second rotor side 6*b* are not in connection with the flow channels leading from the second rotor side 6*b* to the first rotor side 6*a*, so consequently the flows F1 and F2 do not mix with each other. Preferably each flow channel is a dedicated closed channel and is not in connection either with other flow channels of the same side.

The rotor 6 also comprises a sealing lip 9 on its outer rim, which is halfway in the width direction of the rotor 6 and divides the rotor 6 into a first rotor side 6*a* and a second rotor side 6*b* and also keeps the flow channels as well as the air flows, i.e. the flows F1 and F2, separated from each other. Furthermore, at both ends of the rotor 6 are walls, i.e. lips 10*a* and 10*b*, between the outer blades 7 and the inner blades 8, to which lips e.g. a pipe or corresponding means of a ventilation system, can be connected or fastened.

The inner blades 8 of the rotor 6 are shaped in such a way that as viewed from the front they appear curved and sail-shaped. The shape of the outer blades 7 of the rotor 6 are also curved and sail-shaped. The first surface of each outer blade 7 is convex and the other surface is concave. In addition, the inner blades 8 and outer blades 7 turn in a screw-like manner, or like a screw thread, in relation to the center axis, i.e. axis of rotation, of the rotor 6. The outer tip of the outer blades 7 is also bent slightly towards the center axis of the rotor 6.

There is always an extension 8*c* of one inner blade 8 between two outer blades 7. Each outer blade 7 is attached to one extension 8*c* of an inner blade at its edge on the second rotor side 6*b* of the outer blade 7 of the first rotor side 6*a*, and vice versa.

The first rotor side 6*a* and the second rotor side 6*b* are symmetrical to each other, but their inner blades 8 and outer blades 7 have a phase difference with respect to each other, which is seen e.g. in that the edge of each outer blade extending to the sealing lip 9 of the first rotor side 6*a* when viewed directly from the side is essentially at the halfway point in the vertical direction of the edge of two outer blades extending to the sealing lip 9 of the second rotor side 6*b*.

The rotor 6 is arranged to be rotated in such a way that convex surface of the outer blades 7 rotates in front. In FIGS. 2*b* and 2*c* the direction of rotation is marked with the arrow C. Each exhaust channel of the flow is beside one outer blade 7, with respect to the direction of rotation of the rotor 6, behind the outer blade in question.

Instead of what is described in the preceding, the inner blades 8 and/or outer blades 7 could also be different in shape, such as e.g. essentially straight blades that are, however, at a suitable angle with respect to the center axis of the rotor 6, so that they bring about flows when the rotor 6 rotates.

The fan can be used e.g. in the ventilation of a building or vehicle in such a way that supply air is sucked from the first rotor side 6*a* and exhaust air from the second rotor side 6*b*. The fan at the same time functions as a heat exchanger e.g. in such a way that warm exhaust air flowing through the fan heats the colder supply air.

A fan and its rotor 6 is thus arranged to function also as a rotating heat transfer means, i.e. a heat exchanger, as well as a blower. For this purpose, the rotor 6 comprises thermally conductive surfaces and blades. The fan can also comprise other thermally conductive parts and surfaces, e.g. on its frame. In addition, the fan and rotor 6 comprise, if necessary, separate holes removing condensation.

The embodiment described above is well suited for use e.g. in an automobile, particularly well in an electric vehicle.

Figure 3A:
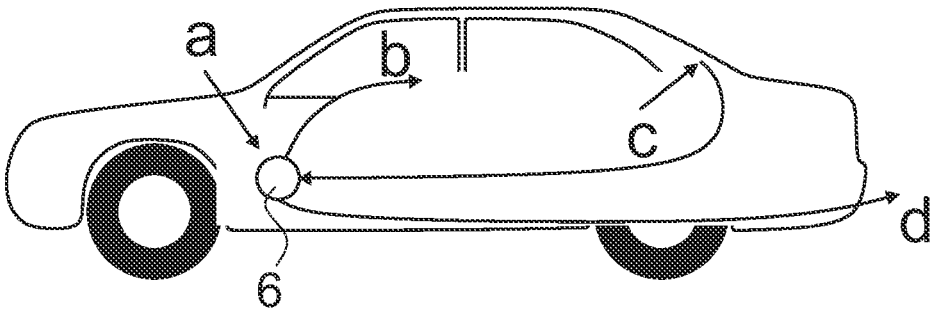
FIG. 3*a* presents a side view of an automobile in which a fan according to the disclosed embodiments can be used.
Figure 3B:
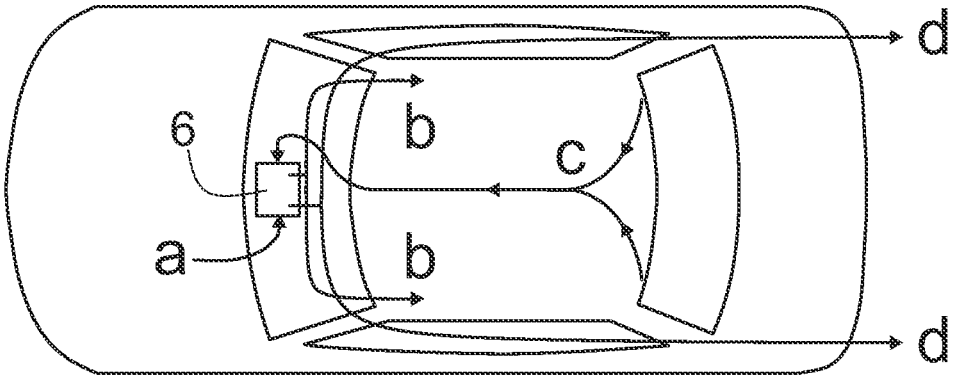
FIG. 3*b* presents a top view of an automobile in which a fan according to the disclosed embodiments can be used.

FIGS. 3*a* and 3*b* present a simplified and diagrammatic automobile and its ventilation system, in which the solution according to the disclosed embodiments, e.g. the solution described in FIGS. 2*a*-2*c*, is used. The fan according to the invention, comprising a rotor 6 producing two flows in different directions, is fitted as a part of the ventilation system of an automobile. The fan is disposed in the front part of the automobile. Supply air a is arranged to be sucked into the fan from the first rotor side 6*a*, which supply air is blown into the interior compartment of the automobile along suitable channels via the second rotor side 6*b* of the fan to become indoor air b. The exhaust air c of the interior compartment is arranged to be sucked into the fan from the second rotor side 6*b*, in which case the exhaust air c warms the supply air. The exhaust air is arranged to be removed from the automobile blown by the first rotor side 6*a* via the exhaust channels d.

Figure 4A:
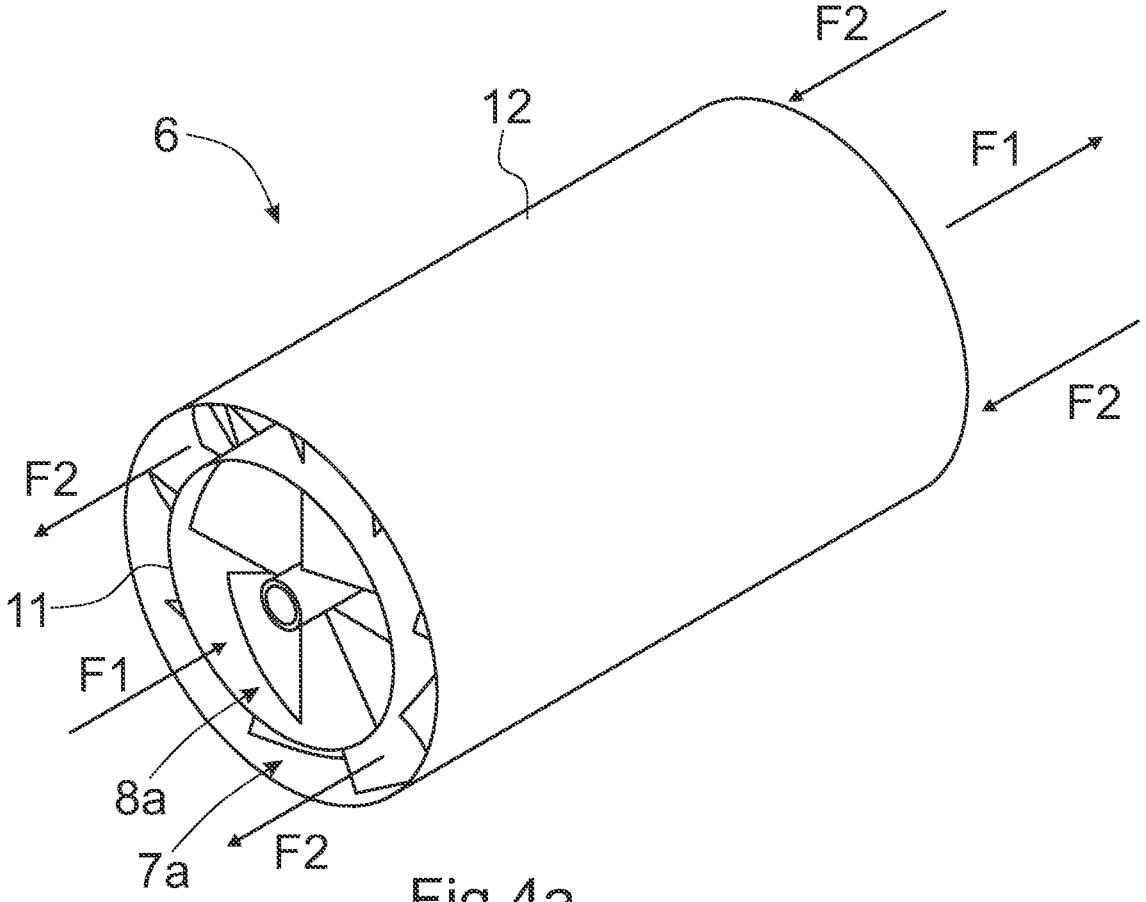
FIG. 4*a* presents an oblique side view of the rotor of a fan according to a second embodiment.
Figure 4B:
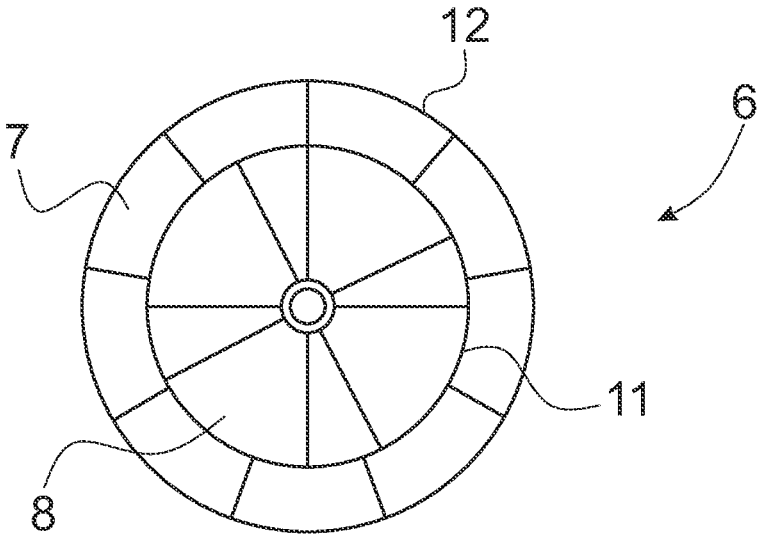
FIG. 4*b* presents a front view of the rotor of a fan according to a second embodiment.

FIG. 4*a* presents an oblique side view and FIG. 4*b* a front view of the rotor of a fan according to a second embodiment In this embodiment the rotor 6 is a drum-shaped rotor that is rotated e.g. by means of an electric motor. The inner blades 8 are fitted in the inner section 8*a* and the outer blades 7 are fitted in the outer section 7*a*. The inner section 8*a* and the outer section 7*a* are separated from each other by means of a dividing wall 11. The angles of the inner blades 8 with respect to the angles of the outer blades 7 are in different directions with respect to the cross-section of the rotor 6, as a result of which the flow F1 brought about the inner blades 8 is in the opposite direction with respect to the flow F2 brought about by the outer blades 7. The angles do not, however, need to be opposite. The strength of the flows F1 and F2, amongst other things, can be adjusted by changing the number and the angles of the blades. When the drum is rotated, the outer blades 7 and inner blades 8 create two separate flows in opposite directions, which flows do not meet or intermix other than via the dividing wall 11 used in the heat exchanger. Heat thus transfers via the dividing wall 11 from one flow to the other, but the fluids of the flows do not mix with each other in the rotor 6.

Alternatively, the angles of the inner blades 8 and of the outer blades 7 are made in such a way that the flows they bring about are in the same direction.

The inner blades 8 and outer blades 7 of the rotor 6 are connected to the same shaft, which a suitable power source, such as e.g. a motor, is arranged to rotate. The inner blades 8 are fastened at their first ends into connection with the shaft and at their second ends to the inner surface of the dividing wall 11. The outer blades 7 are fastened at their first ends into connection with the outer surface of the dividing wall 11 and at their second ends to the inner surface of the outer wall 12.

The rotor 6 is also arranged to spin out by centrifugal force the medium, usually water, condensing on it. This can be made more efficient by perforating the dividing wall 11 and/or the outer wall 12 and/or by making the inner blades 8 and/or the outer blades 7 hollow.

Figure 5A:
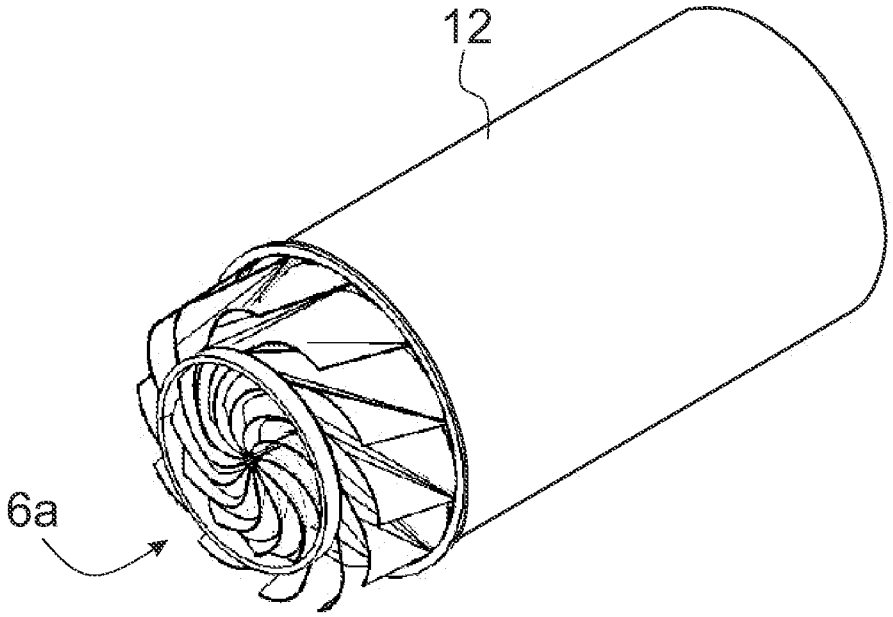
FIG. 5*a* presents an oblique side view of the rotor of a fan according to a third embodiment and FIG. 5*b* presents a side view of the rotor of a fan according to a third embodiment.
Figure 5B:
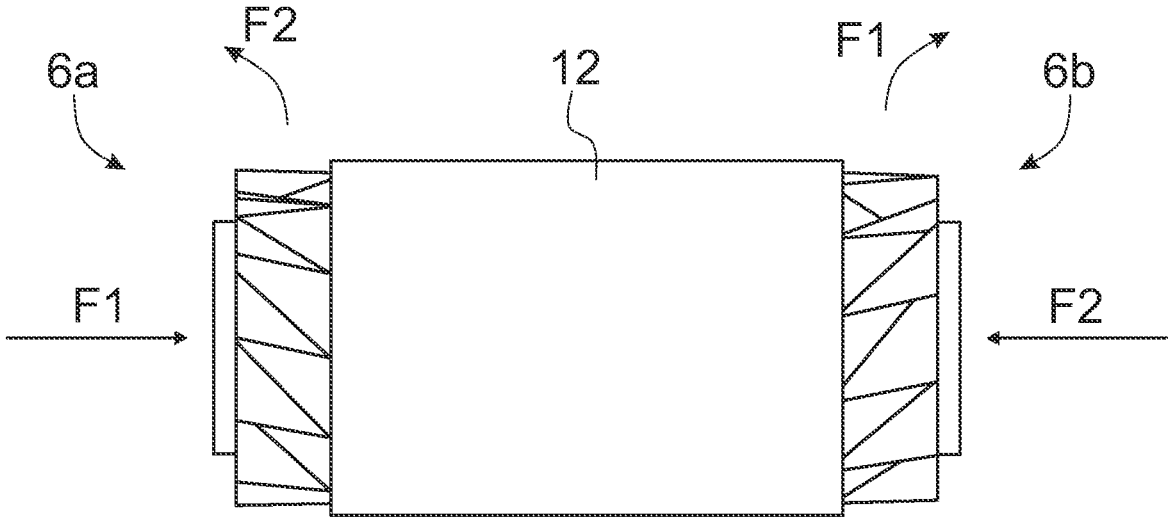
Figure 6A:
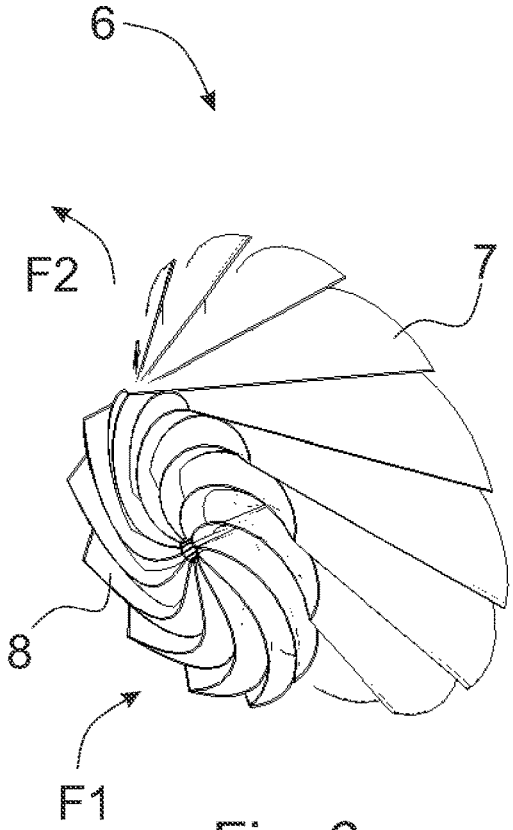
FIG. 6*a* presents an oblique side view of one blade solution for a fan according to the disclosed embodiments.
Figure 6B:
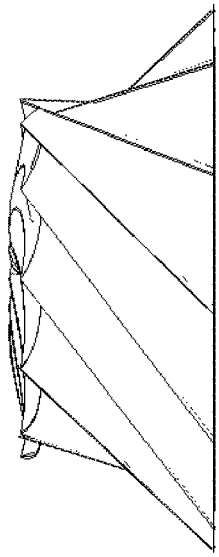
FIG. 6*b* presents a side view of one blade solution for a fan according to the disclosed embodiments.
Figure 6C:
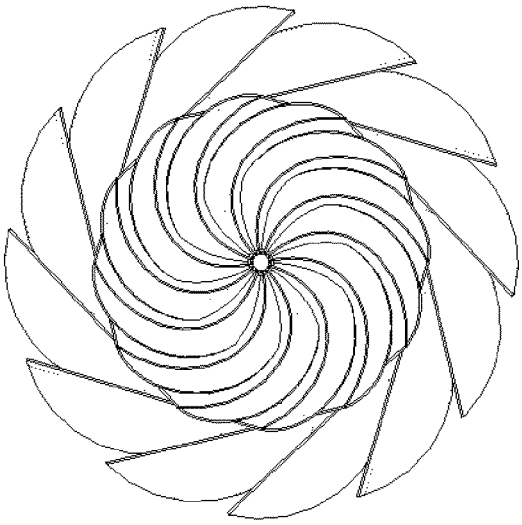
FIG. 6*c* presents a front view of one blade solution for a fan according to the disclosed embodiments.
Figure 6D:
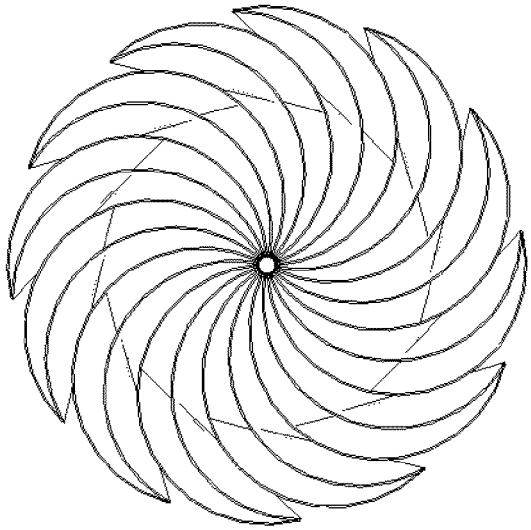
FIG. 6*d* presents a rear view of one fan according to the disclosed embodiments.

FIG. 5*a* presents an oblique side view and FIG. 5*b* a side view of the rotor for a fan according to a third embodiment, which is well suited e.g. to mobile homes, automobiles, boats, or buildings. In FIG. 5*a* the rotor 6 is sectioned in such a way that only the first rotor side 6*a* is visible in the figure. In the rotor 6 of this embodiment, more heat transfer surface area, compared to the embodiment presented in FIGS. 2*a*-2*c*, has been added with a drum, comprising an outer wall 12. The flow channels travel inside the drum in such a way that in every second flow channel the first flow F1 flows in a first flow direction and in every other flow channel the second flow F2 flows in a second flow direction, which is the opposite to the first flow direction F1. Inside the drum are just as many flow channels as the total number of inner blades and outer blades on one rotor side.

FIGS. 6*a*-6*d* present one blade solution according to the disclosed embodiments, which is well suited e.g. for use in the solution presented in FIGS. 5*a* and 5*b*. This type of blade solution can be fitted e.g. in both ends of the heat exchanger drum, and it comprises outer blades 7 and inner blades 8, which are arranged to form separate flows F1 and F2 in opposite directions. With this type of blade solution the necessary separated flows are obtained with the individual surfaces from the center part and outer part of the rotor into the alternate channels in the wider end on the heat exchanger side.

The fan solution according to the disclosed embodiments can be used also for utilizing the exhaust air flow e.g. by conducting air through the batteries, or around the batteries, of an electric vehicle to protect the batteries from hot and/or freezing weather.

The fan solution according to the disclosed embodiments can be used also in an arrangement wherein fluid is arranged as a dedicated channel around the blades of the fan or around the channels of a heat exchanger, and heat is recovered into the fluid e.g. for use in a heat pump or to perform the task of a cooler and/or heater radiator. The simplest embodiment is to use a heat transfer fan in a vertical attitude to the shaft and to drain the fluid from the exhaust air channel of the fan and to collect the filtered fluid from the pool for use with a separate pump solution.

The shaping of the radiator of the heat exchanger can be utilized to increase the surface area and to stabilize the pressure inside the radiator for certain speeds of rotation. Temperature variation causes a pressure change and this can be compensated with changes in the size of the channels for reducing pumping losses.

As mentioned in connection with some of the aforementioned embodiments, there can be holes in the fan and in the rotor 6 for removing condensation. These holes are preferably small and they can be e.g. in the frame, casing and/or blades of the rotor 6. The inner blades 8 and/or the outer blades 7 can also be made hollow for removing condensation.

The fan/fan solution and ventilation arrangement according to the disclosed embodiments can thus be used in, inter alia, the ventilation, airing and air conditioning systems of different types of buildings, premises, and vehicles, such as e.g. automobiles.

Preferably the rotor 6 as well as the inner blades 8 and outer blades 7 according to the disclosed embodiments are fabricated into a single piece e.g. by casting, 3D printing or in some other suitable manner. The structure of the rotor 6 is designed e.g. in such a way that the inner blades 8 and the outer blades 7 adhere to each other and when rotating form the desired flows in the manner suited to each specific purpose.

It is obvious to the person skilled in the art that the invention is not limited solely to the examples described above, but that it may be varied within the scope of the claims presented below. Thus, for example, the structure of the fan and its rotor according to the invention can also be different to those in the embodiments presented above.

It is also obvious to the person skilled in the art that, instead of an electric motor, the rotor can be rotated also by means of some other power source such as e.g. by the force of a flow formed mechanically or by a pressure difference or by a pneumatic or hydraulic power source.

What is claimed is:

1. A fan for displacing a fluid, which fan comprises a single rotor rotating around its axis of rotation, the rotor comprising blades forming a flow when the rotor rotates, and the rotor is arranged to displace fluid simultaneously with at least two different flows (F1, F2), wherein the blades are configured to be thermally conductive surfaces for transferring heat from a first flow (F1) of the two different flows to a second flow (F2) of the two different flows.

2. The fan according to claim 1, wherein the blades of the rotor comprise inner blades and outer blades, the inner blades and the outer blades being configure to be rotated at a same time and at a same angular velocity.

3. The fan according to claim 2, wherein the inner blades are configure to displace fluid as the first flow (F1) and the outer blades are configure to displace fluid as the second flow (F2).

4. The fan according to claim 3, wherein the rotor comprises one or more flow channels for the first flow (F1) and one or more flow channels for the second flow (F2).

5. The fan according to claim 4, wherein the flow channels are led from a first rotor side of the rotor to a second rotor side of the rotor.

6. The fan according to claim 4, wherein the flow channels are led from the inner blades of the rotor to the outer blades of the rotor.

7. The fan according to claim 4, wherein the one or more flow channels-for the first flow (F1) and the one or more flow channels for the second flow (F2) of the rotor are configure to be one beside another in such a way that heat transfer from the first flow (F1) to the second flow (F2) occurs by one or more of conduction, convection and condensation.

8. The fan according to claim 1, wherein the first flow (F1) is separate from the second flow (F2) and the first flow (F1) is in a same direction as the second flow (F2).

9. The fan according to claim 1, wherein the blades of the rotor are shaped to be curved in order to spin moisture condensed on surfaces of the rotor off the surfaces of the rotor.

10. The fan according to claim 1, wherein in one or more of a frame, casing and blades of the rotor are holes for removing a condensing medium.

11. The fan according to claim 1, wherein the fluid to be displaced is a gas, such as air.

12. Use of a fan according to claim 1 in a ventilation of a vehicle, such as an automobile.

13. Use of a fan according to claim 1 in a ventilation of a building.

14. The fan according to claim 1, wherein the first flow (F1) is separate from the second flow (F2) and the first flow (F1) is in a different direction from the second flow (F2).

* * * * *